US009546557B2

(12) United States Patent
Grooms, III et al.

(10) Patent No.: US 9,546,557 B2
(45) Date of Patent: Jan. 17, 2017

(54) NOZZLE, A NOZZLE HANGER, AND A CERAMIC TO METAL ATTACHMENT SYSTEM

(71) Applicant: GENERAL ELECTRIC COMPANY, Schenectady, NY (US)

(72) Inventors: James Hamilton Grooms, III, Hamilton, OH (US); Darrell Glenn Senile, Cincinnati, OH (US); Charles Thomas McMillan, Cincinnati, OH (US); Michael Todd Radwanski, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 731 days.

(21) Appl. No.: 13/804,402

(22) Filed: Mar. 14, 2013

(65) Prior Publication Data

US 2014/0001285 A1 Jan. 2, 2014

Related U.S. Application Data

(60) Provisional application No. 61/666,411, filed on Jun. 29, 2012.

(51) Int. Cl.
*F01D 9/02* (2006.01)
*F01D 25/00* (2006.01)
(Continued)

(52) U.S. Cl.
CPC . *F01D 9/02* (2013.01); *F01D 5/18* (2013.01); *F01D 5/284* (2013.01); *F01D 9/04* (2013.01);
(Continued)

(58) Field of Classification Search
CPC ..... F01D 5/18; F01D 5/284; F01D 9/04; F01D 9/042; F01D 9/02; F01D 25/00; F01D 25/246; F01D 11/001; F05D 2240/11; F05D 2300/20
See application file for complete search history.

(56) References Cited

U.S. PATENT DOCUMENTS 4,384,822 A * 5/1983 Schweikl ..... F01D 9/042 415/115
4,907,946 A * 3/1990 Ciokajlo ..... F01D 9/042 415/135
(Continued)

FOREIGN PATENT DOCUMENTS

EP 1013885 A2 6/2000
EP 1149984 A2 10/2001
(Continued)

OTHER PUBLICATIONS

Search Report and Written Opinion from PCT/US2013/043265 dated Aug. 28, 2013.

*Primary Examiner* — Carlos A Rivera
(74) *Attorney, Agent, or Firm* — General Electric Company; Brian P. Overbeck

(57) ABSTRACT

A nozzle, a nozzle hanger, and a ceramic to metal attachment system are provided. The ceramic to metal attachment system includes the nozzle, a ceramic matrix composite, and the nozzle hanger, a metal. The attachment system also includes a clamping member adjacent a second surface of the nozzle and a mounting member of the nozzle. The attachment system includes a plurality of attachment members securing the nozzle, the clamping member, and the nozzle hanger together. A sealing member of the nozzle hanger seals off an airfoil of the nozzle from adjacent airflow.

11 Claims, 8 Drawing Sheets

(51) Int. Cl.

| | |
|---|---|
| ***F01D 5/18*** | (2006.01) |
| ***F01D 9/04*** | (2006.01) |
| ***F01D 5/28*** | (2006.01) |
| ***F01D 11/00*** | (2006.01) |
| ***F01D 25/24*** | (2006.01) |

(52) U.S. Cl.
CPC ..... *F01D 9/042* (2013.01); *F01D 11/001* (2013.01); *F01D 25/00* (2013.01); *F01D 25/246* (2013.01); *F05D 2240/11* (2013.01); *F05D 2300/20* (2013.01)

(56) References Cited

U.S. PATENT DOCUMENTS

| | | | | |
|---|---|---|---|---|
| 5,248,240 | A * | 9/1993 | Correia | F01D 9/042 415/191 |
| 7,798,775 | B2 * | 9/2010 | Kammel | F01D 9/041 248/205.5 |
| 2003/0133802 | A1 | 7/2003 | Tiemann | |
| 2009/0246012 | A1 * | 10/2009 | Shapiro | F01D 9/042 415/208.1 |
| 2011/0008163 | A1 * | 1/2011 | Prentice | F01D 5/282 415/209.3 |
| 2012/0128482 | A1 * | 5/2012 | Dezouche | F04D 29/542 415/209.2 |

FOREIGN PATENT DOCUMENTS

| | | | |
|---|---|---|---|
| EP | 1939411 | A2 | 7/2008 |
| GB | 2244523 | A | 12/1991 |
| WO | 2011005336 | A1 | 1/2011 |

* cited by examiner

NOZZLE, A NOZZLE HANGER, AND A CERAMIC TO METAL ATTACHMENT SYSTEM

CROSS-REFERENCE TO RELATED APPLICATIONS

This patent application claims the benefit of U.S. Provisional Patent Application Ser. No. 61/666,411 filed on Jun. 29, 2012 and entitled "A NOZZLE, A NOZZLE HANGER, AND A CERAMIC TO METAL ATTACHMENT," the disclosure of which is incorporated by reference as if fully rewritten herein.

FIELD OF THE INVENTION

The present invention relates generally to turbines. More specifically, to a nozzle, a nozzle hanger, and a ceramic to metal attachment system for turbines.

BACKGROUND OF THE INVENTION

A number of techniques have been used in the past to manufacture turbine engine components, such as turbine blades or nozzles using ceramic matrix composites (CMC). One method of manufacturing CMC components relates to the production of silicon carbide matrix composites containing fibrous material that is infiltrated with molten silicon, herein referred to as the Silcomp process. The fibers generally have diameters of about 140 micrometers or greater, which prevents intricate, complex shapes, such as turbine blade components, to be manufactured by the Silcomp process.

Another technique of manufacturing CMC turbine blades is the method known as the slurry cast melt infiltration (MI) process. In one method of manufacturing using the slurry cast MI method, CMCs are produced by initially providing plies of balanced two-dimensional (2D) woven cloth comprising silicon carbide (SiC)-containing fibers, having two weave directions at substantially 90° angles to each other, with substantially the same number of fibers running in both directions of the weave.

Generally, such turbine components require attachment to adjoining metallic hardware and/or metallic surfaces. Two disadvantages associated with attaching a CMC to metallic hardware are the wear of the metallic hardware by the hard, abrasive ceramic material surface, and the lack of load distribution in the CMC. Load distribution is critical in the interfaces between the CMC components and metal surfaces, such as shrouds. Typically, metallic shims or ceramic cloths have been interposed between the CMC and metallic surfaces to improve load distribution. Wear is typically reduced by the application of coatings to the metallic hardware or coatings to the nozzle attachment surfaces.

Therefore, a nozzle, a nozzle hanger, and a ceramic matrix composite to metal attachment system that do not suffer from the above drawbacks is desirable in the art.

SUMMARY OF THE INVENTION

According to an exemplary embodiment of the present disclosure, a nozzle is provided. The nozzle includes a first band, a second band, an airfoil joining the first band and the second band, and a mounting member integrally formed with the second band and the airfoil. The mounting member has a first surface and a second surface. The mounting member includes a cavity extending through the airfoil. The mounting member includes a radial outer load bearing surface surrounding the cavity. The mounting member includes a radial inner load bearing surface opposite the radial outer load bearing surface. The mounting member includes a tangential interface between the radial outer load bearing surface and the radial inner load bearing surface. The mounting member includes a moment interface surface between the radial outer load bearing surface and the radial inner load bearing surface and opposite the tangential interface. The mounting member attaches the nozzle to a surrounding static surface.

According to another exemplary embodiment of the present disclosure, a nozzle hanger is provided. The nozzle hanger includes a nozzle receiving surface and a shroud hanger integrally formed with and adjacent to the nozzle receiving surface. The nozzle hanger includes an axial load bearing surface approximately perpendicular to the nozzle receiving surface. The nozzle hanger includes a tangential load bearing surface approximately perpendicular to the nozzle receiving surface. The nozzle hanger includes a moment load bearing surface opposite the tangential load bearing surface. The nozzle hanger receives a nozzle and transfers load of nozzle and hanger to a surrounding static structure.

According to another exemplary embodiment of the present disclosure, a ceramic to metal attachment system is provided. The ceramic to metal attachment system includes a nozzle, a nozzle hanger, a clamping member, and a plurality of attachment members. The nozzle includes first band, a second band, an airfoil joining the first band and the second band, and a mounting member integrally formed with the second band and the airfoil. The mounting member of the nozzle has a first surface and a second surface, and includes a cavity extending through the airfoil. The mounting member of the nozzle includes a radial outer load bearing surface surrounding the cavity. The mounting member of the nozzle includes a radial inner load bearing surface opposite the radial outer load bearing surface. The mounting member of the nozzle includes a tangential interface between the radial outer load bearing surface and the radial inner load bearing surface. The mounting member of the nozzle includes a moment interface surface between the radial outer load bearing surface and the radial inner load bearing surface and opposite the tangential interface. The mounting member of the nozzle attaches the nozzle to a surrounding static surface. The nozzle hanger includes a nozzle receiving surface and a shroud hanger integrally formed with and adjacent to the nozzle receiving surface. The nozzle hanger includes an axial load bearing surface approximately perpendicular to the nozzle receiving surface. The nozzle hanger includes a tangential load bearing surface approximately perpendicular to the nozzle receiving surface. The nozzle hanger includes a moment load bearing surface opposite the tangential load bearing surface. The nozzle hanger includes a sealing member surrounding the cavity and situated between the nozzle receiving surface and the nozzle. The nozzle hanger receives a nozzle and transfers load of nozzle and hanger to a surrounding static structure. The clamping member is adjacent the second surface of the nozzle and the mounting member of the nozzle. The plurality of attachment members secure the nozzle, the clamping member and the nozzle hanger together. The sealing member of the nozzle hanger seals off the airfoil from adjacent airflow.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a nozzle, a nozzle hanger, and a ceramic to metal attachment system.

One advantage of an embodiment of the present disclosure includes that ceramic matrix composite (CMC) nozzles may be operated at higher temperatures than traditional metal nozzles. Another advantage of an embodiment includes attachment of a CMC nozzle in a cantilevered position. Yet another advantage of an embodiment of the present disclosure includes a system for attaching CMC nozzles to metal nozzle hangers. Another advantage of the present disclosure includes a system for attaching metal nozzles to metal nozzle hangers. Yet another advantage of an embodiment is that system provides a direct load path from the airfoil to the attachment. Another advantage of an embodiment is that nozzle component stresses are reduced. Yet another advantage of the present disclosure is that the system allows for different thermal growth of the nozzle and the attachment hanger. Another advantage of the present disclosure is that the system provides convenient placement for airfoil cavity sealing.

Figure 1:
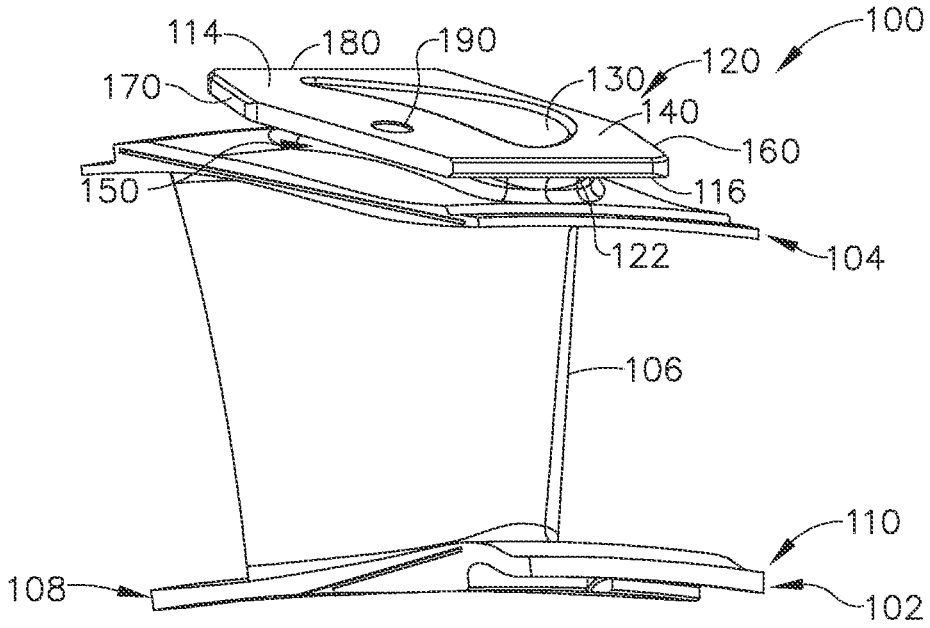
FIG. 1 is a perspective schematic side view of a nozzle of the present disclosure.
Figure 2:
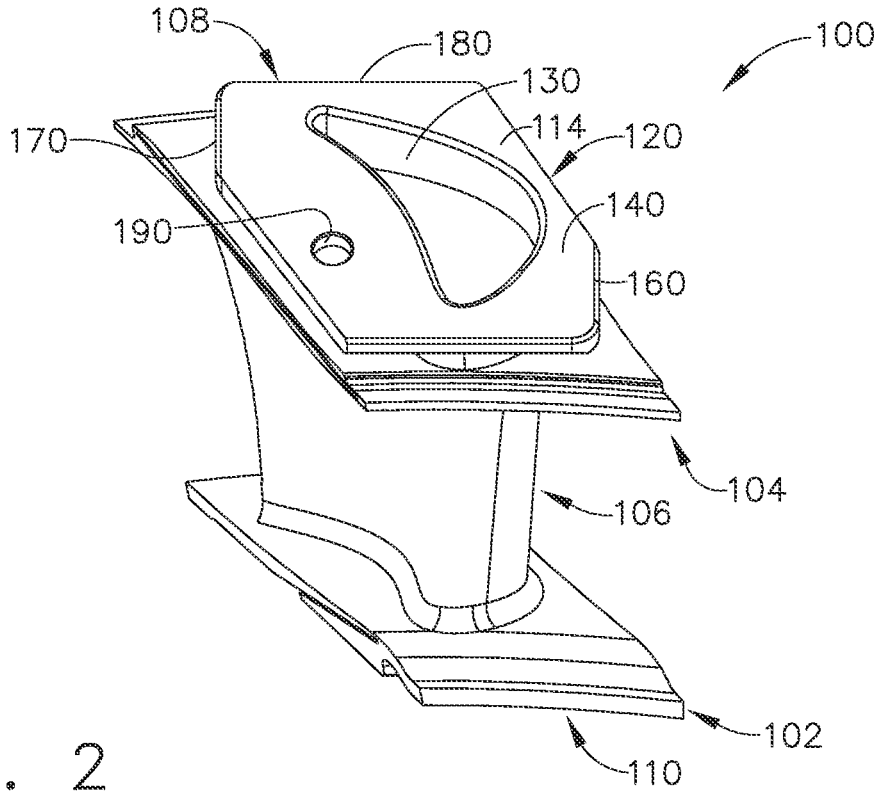
FIG. 2 is a perspective schematic top view of a nozzle of the present disclosure.
Figure 3:
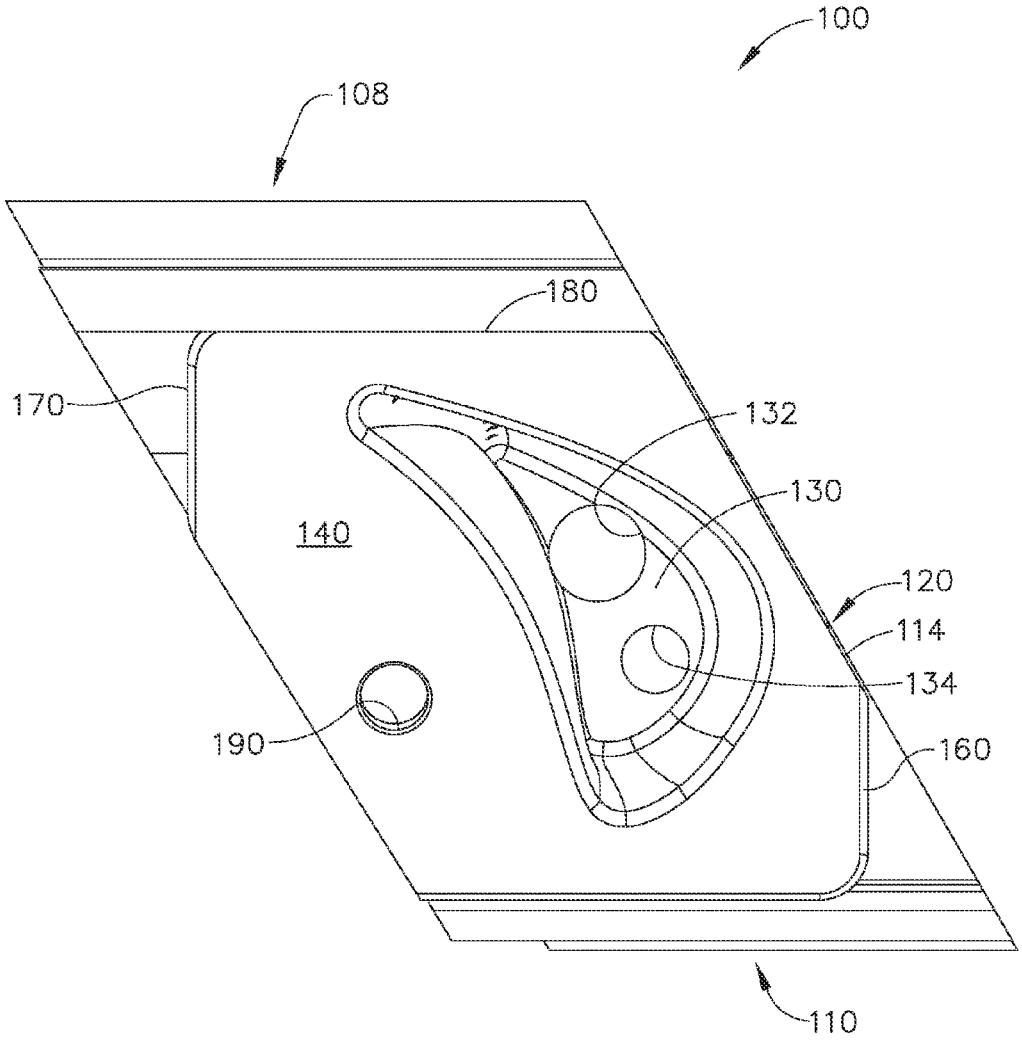
FIG. 3 is a schematic top view of a nozzle of the present disclosure.

FIG. 1 is a perspective schematic side view of a nozzle 100. According to one embodiment, nozzle may have a forward end and an aft end. For example, as depicted in FIGS. 1-3, nozzle 100 has a forward end 110 and an aft end 108. Nozzle 100 may include a first band 102, a second band 104, and an airfoil 106 joining first band 102 and second band 104. As used herein, "band" means an upper or lower portion of the nozzle used to define the top and bottom of airfoil passage. Nozzle 100 may be a ceramic matrix composite (CMC) and may be formed using a suitable lay-up technique or other known CMC component making technique. Nozzle 100 may include a mounting member 120 integrally formed with second band 104 and airfoil 106. Mounting member 120 may have a first surface 114 and a second surface 116. Mounting member 120 may include a cavity 130 extending through airfoil 106. Mounting member 120 may include a radial outer load bearing surface 140 on first surface 114 of second band 104. Radial outer load bearing surface 140 may surround cavity 130. Radial outer load bearing surface 140 may receive and carry pressure load from nozzle 100 during operation. Mounting member 120 may include a radial inner load bearing surface 150 on second surface 116 of second band 104 and opposite radial outer load bearing surface 140. Radial inner load bearing surface 150 may receive and carry pressure load from nozzle 100 during operation. Mounting member 120 may include a tangential interface 160 between radial outer load bearing surface 140 and radial inner load bearing surface 150. In one embodiment, tangential interface 160 may receive and carry pressure load from nozzle 100 during operation. Mounting member 120 may include a moment interface 170 between radial outer load bearing surface 140 and radial inner load bearing surface 150 and opposite tangential interface 160. Mounting member 120 may attach nozzle 100 to a surrounding static surface 800, such a case (see FIG. 8).

According to one embodiment, mounting member may include an axial interface adjacent a moment interface and between a radial outer load bearing surface and a radial inner load bearing surface. For example, as illustrated in FIGS. 1-3, mounting member 120 may include an axial interface 180 adjacent moment interface 170 and between radial outer load bearing surface 140 and radial inner load bearing surface 150. Mounting member 120 may include mounting hole 190 for receiving attachment member 702 (see FIGS. 7-8). As shown in FIG. 1, mounting member 120 may be integrally formed with second band 104 and airfoil 106 and may include a space 122 between second surface 116 of mounting member 120 and second band 104. Space 122 may be adapted to receive a clamping member 710 (see FIGS. 7-10). Mounting member 120 may be designed to complement and fit a nozzle hanger 400 such that mounting member 120 and nozzle hanger 400 may have complementary angled surfaces. Angle may be anywhere from about 0 degrees to about 45 degrees, or alternatively about 5 degrees to about 40 degrees, or alternatively about 10 degrees to about 35 degrees. In one embodiment, the angle may be chosen to match flow path. As shown in FIG. 3, cavity 130 is formed in mounting member 120 and runs through airfoil 106 and first band 102. In one embodiment, cavity 130 includes at least one aperture 132 for cooling air and a passage 134 for a bolt to attach to a seal box (not shown).

Figure 4:
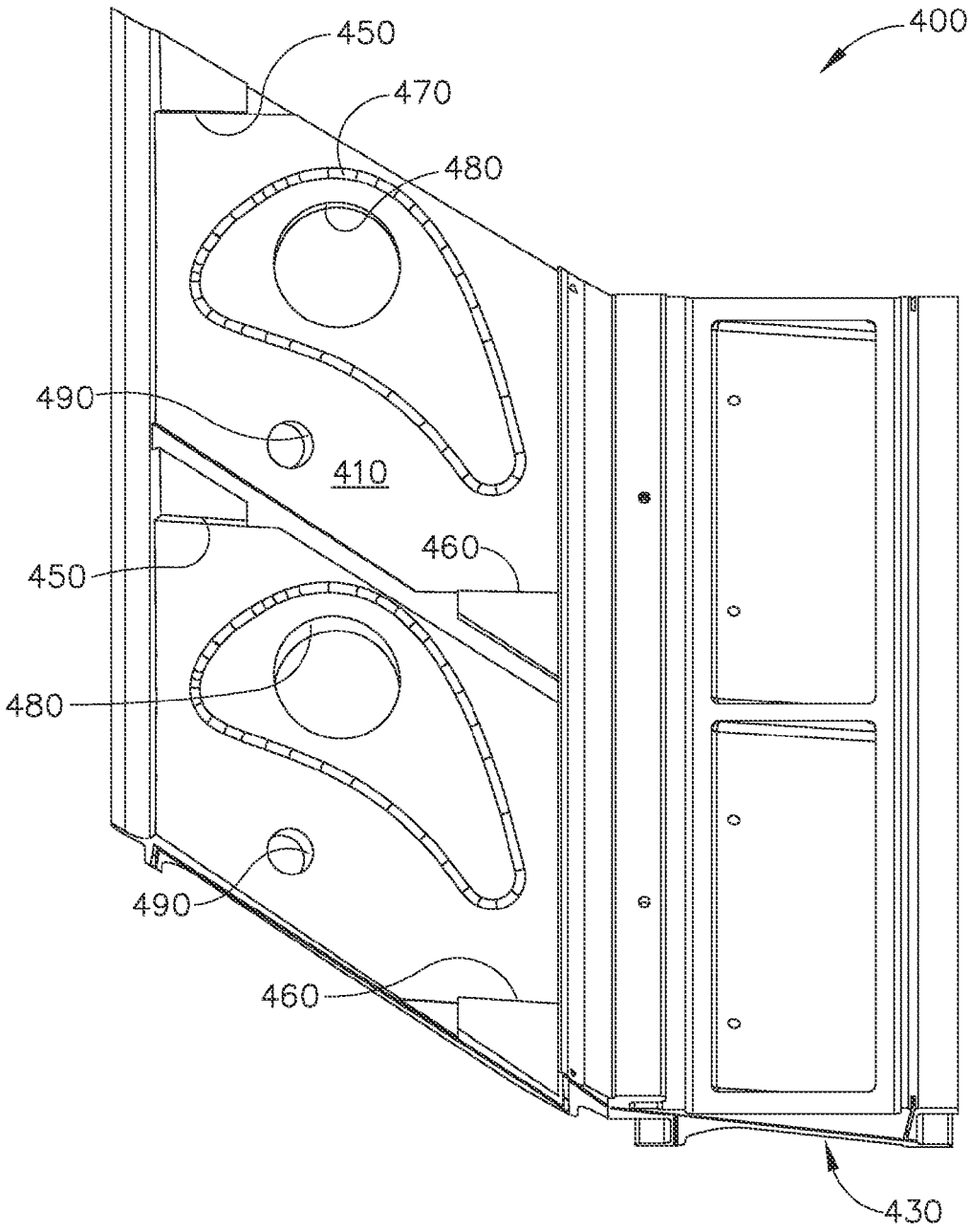
FIG. 4 is a perspective schematic bottom view of a nozzle hanger of the present disclosure.
Figure 5:
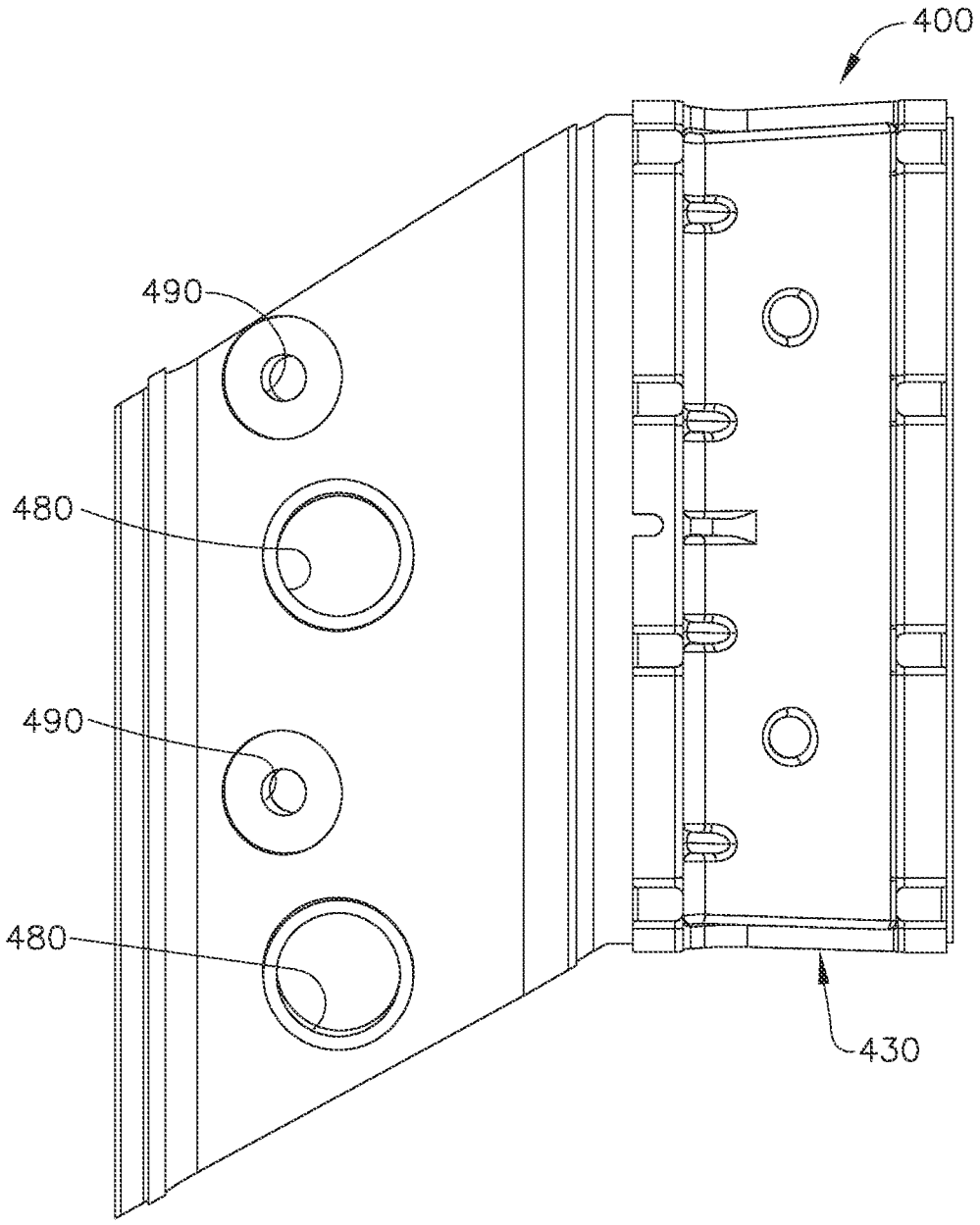
FIG. 5 is a perspective schematic top view of a nozzle hanger of the present disclosure.
Figure 6:
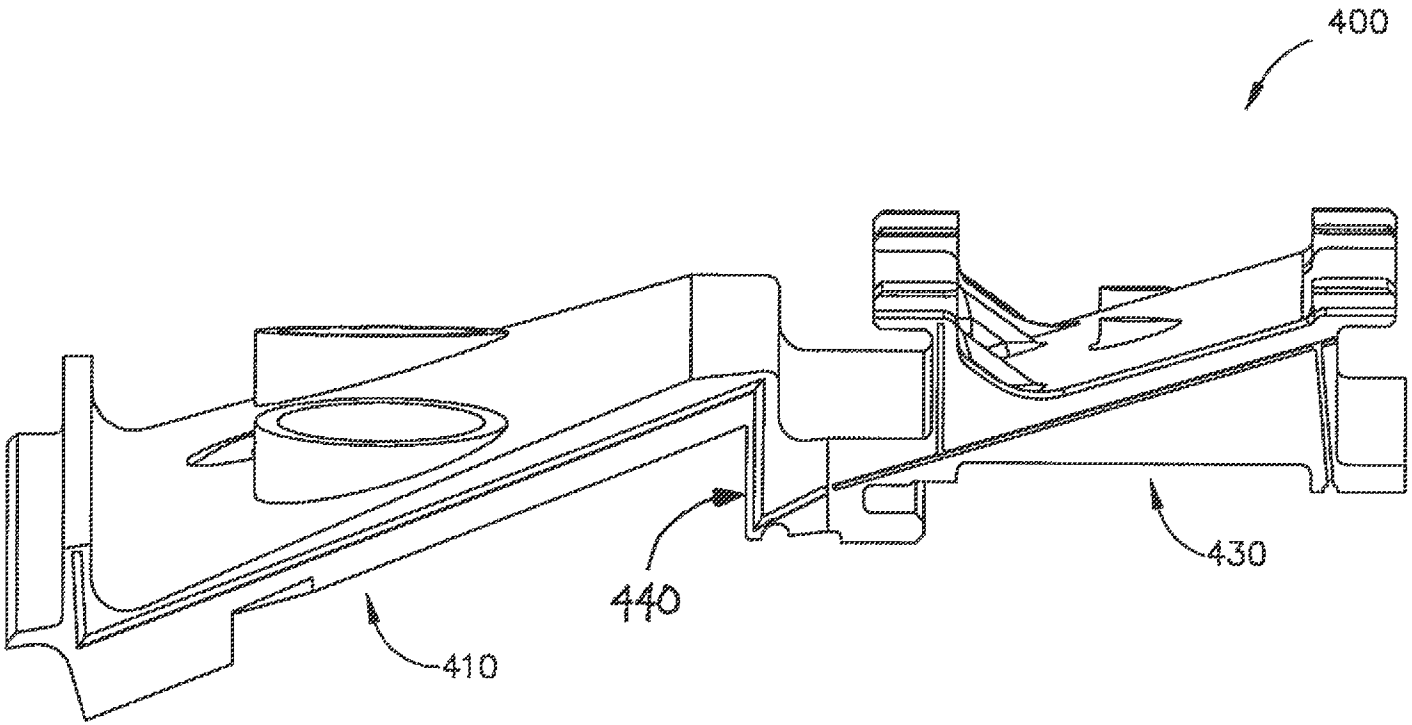
FIG. 6 is a schematic side view of a nozzle hanger of the present disclosure.

According to one embodiment, a nozzle hanger is provided. For example, FIGS. 4-6 illustrate an embodiment of a nozzle hanger 400 of the present disclosure. FIG. 4 is a perspective schematic top view of nozzle hanger 400. Nozzle hanger 400 may be constructed from nickel-based or cobalt-based superalloys. Nozzle hanger 400 may include a nozzle receiving surface 410 for receiving nozzle 100. Nozzle hanger 400 may include a shroud hanger 430 integrally formed with and adjacent to nozzle receiving surface 410. Shroud hanger 430 may be operable to attach nozzle hanger 400 to a static structure 800, a case (see FIG. 8). Nozzle hanger 400 may include an axial load bearing surface 440 approximately perpendicular to nozzle receiving surface 410. As used herein "approximately perpendicular" is about ±25 degrees. Nozzle hanger 400 may include a tangential load bearing surface 450 approximately perpendicular to nozzle receiving surface 410. Nozzle hanger 400 may include a moment load bearing surface 460 opposite tangential load bearing surface 450. Nozzle hanger 400 may receive nozzle 100 at nozzle receiving surface 410 and may transfer load of nozzle 100 and nozzle hanger 100 to a surrounding static structure 800, such as a shroud (see FIG. 8). For example, as shown in FIG. 5, nozzle hanger 400 may include at least one passage 480 for receiving cooling air for airfoil 106 cavity 130. As depicted, nozzle hanger 400 may include two seal grooves 470 for receiving nozzle 100. Seal grooves 470 may receive sealing members, such as, but not limited to, rope seals and ceramic seals, thereby sealing off airfoil 106 from adjacent airflow. In an alternative embodiment, nozzle hanger 400 may be a single segment or any number of segments that make up a 360° degree ring. As shown in FIG. 6, nozzle hanger 400 may be one piece; however, in alternative embodiment nozzle hanger 400 may be two or more pieces.

Figure 7:
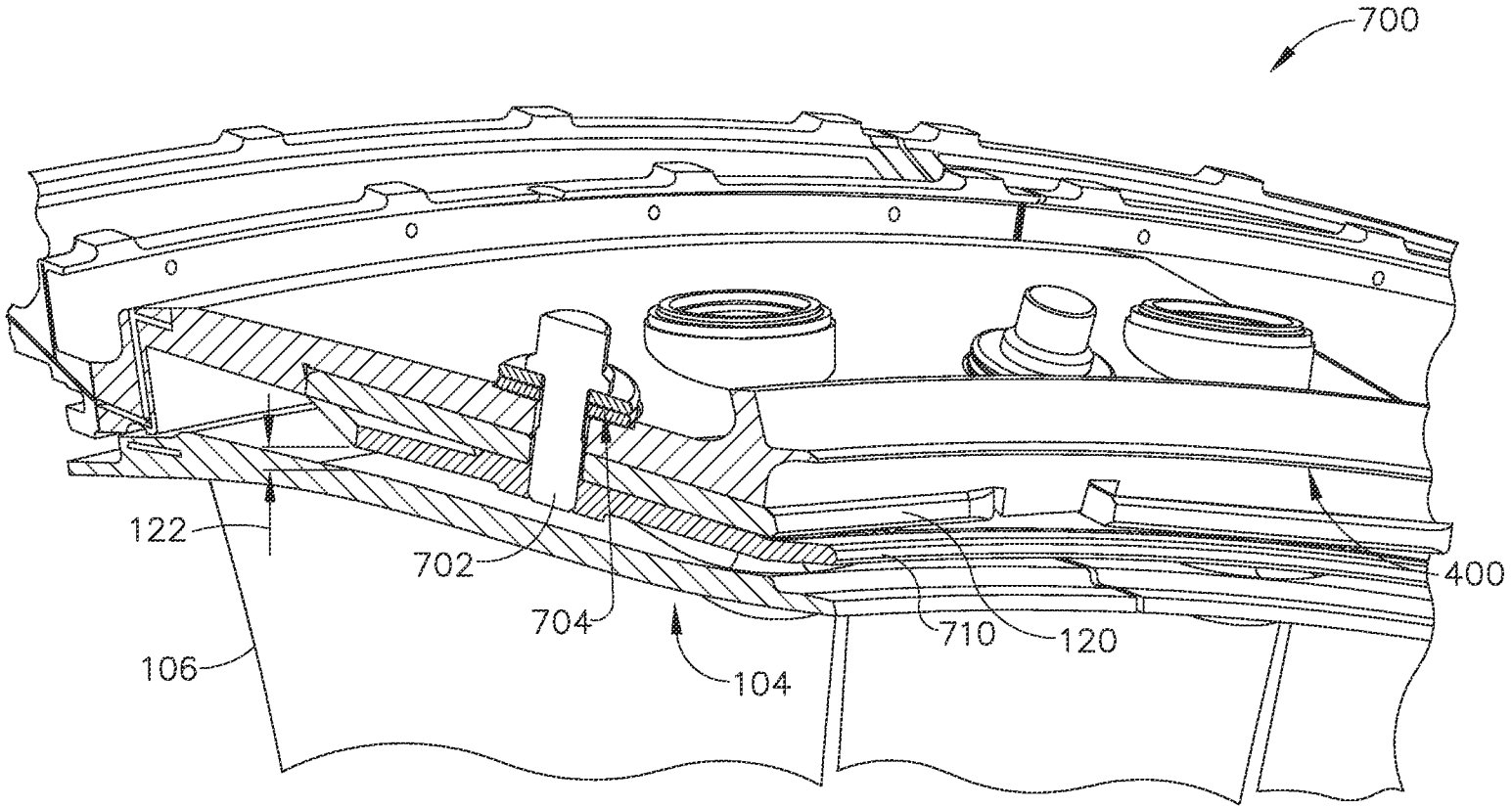
FIG. 7 is a partial perspective schematic of a portion of a ceramic to metal attachment system of the present disclosure.
Figure 8:
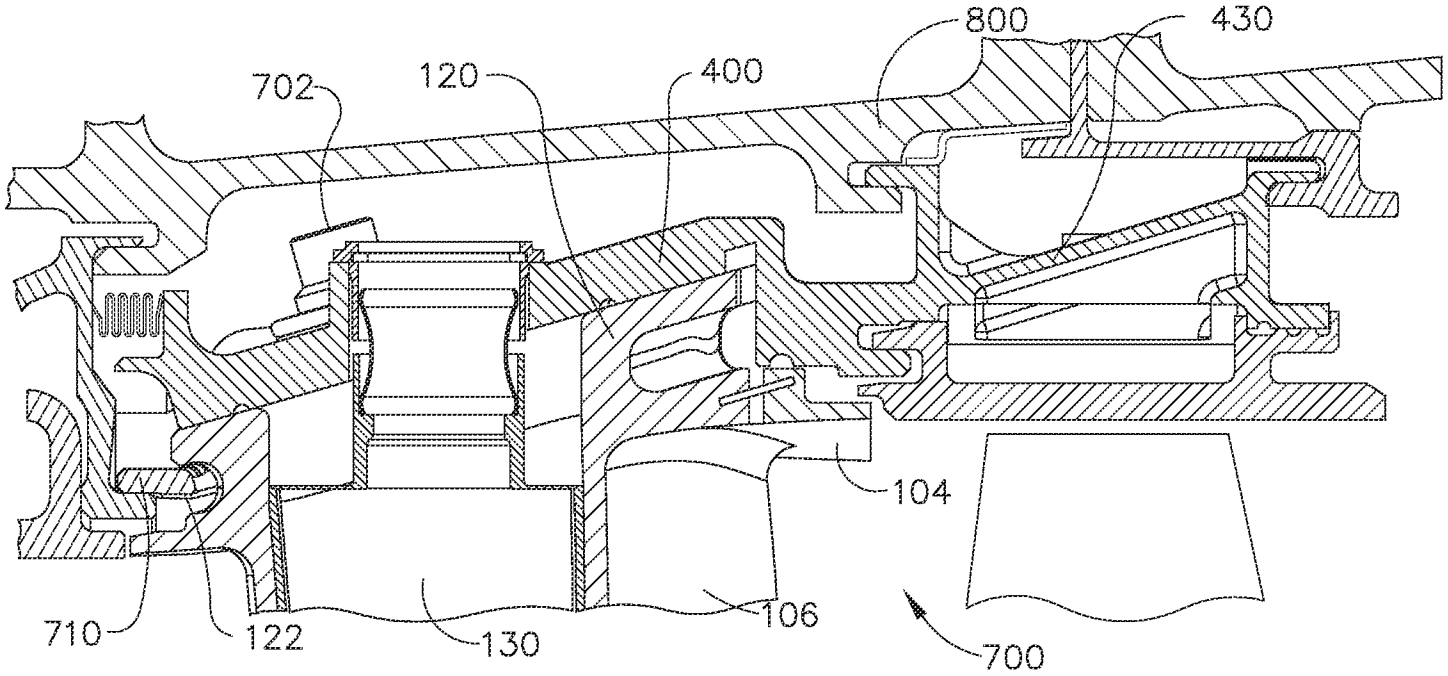
FIG. 8 is a side section view of a ceramic to metal attachment system of the present disclosure.

According to one embodiment, a ceramic to metal attachment system including a nozzle, a nozzle hanger, a clamping member, and a plurality of attachment members is provided. For example, FIGS. 7 and 8 illustrate a ceramic to metal attachment system 700. Ceramic to metal attachment system 700 may include nozzle 100, nozzle hanger 400, clamping member 710, and plurality of attachment members 702. Nozzle 100 may cooperate with and attach to nozzle hanger 400. As shown in FIG. 8, both nozzle 100 and nozzle hanger 400 may include an angle, allowing nozzle 100 to have a cantilevered configuration. Clamping member 710 may be located in space 122 adjacent second band 104 and the mounting member 120 of nozzle 100. Clamping member 710 may reduce vibration of nozzle 100 and may secure nozzle 100 in space 122. Attachment members 702 and washers 704 may secure nozzle 100, clamping member 710 and nozzle hanger 400 together. Nozzle 100 may include mounting hole 190 for receiving attachment member 702. Clamping member 710 may include bolt hole 990 for receiving attachment member 702. Nozzle hanger 400 may include aperture 490 for receiving attachment member 702. In one embodiment, for example, as depicted in FIG. 7, mounting hole 190 (see FIG. 1), bolt hole 990 (see FIG. 9) and aperture 490 (see FIG. 4) may align to receive attachment member 702.

Figure 9:
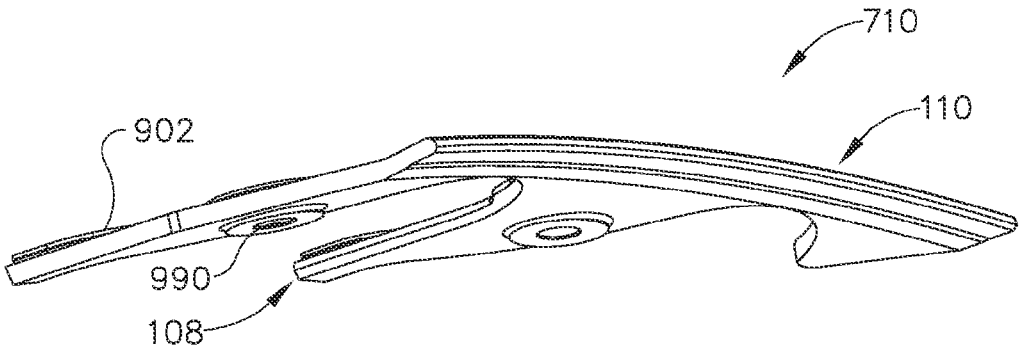
FIG. 9 is a perspective view of a clamping member of the present disclosure.
Figure 10:
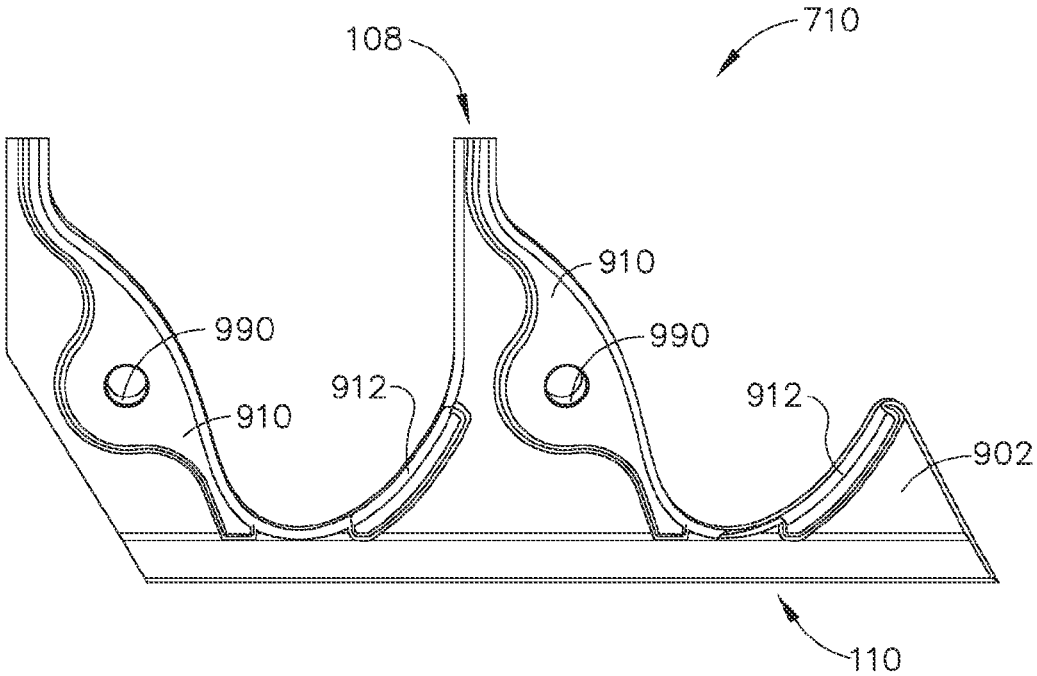
FIG. 10 is a top view of a clamping member of the present disclosure.

According to one embodiment, a clamping member is provided. For example, FIGS. 9 and 10 illustrate an embodiment of a clamping member 710. First surface 902 of clamping member 710 may include a plurality of raised surfaces 910 and 912. First raised surface 910 may cooperate with radial inner load bearing surface 150 of mounting member 120. Second raised surface 912 may cooperate with second surface 116 of mounting member 120. Clamping member 710 may be constructed from a metal, such as but not limited to, nickel-based or cobalt-based superalloys.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A nozzle comprising:
a first band;
a second band;
an airfoil joining the first band and the second band; and
a mounting member integrally formed with the second band and the airfoil, the mounting member having a first surface and a second surface, the mounting member including:
a cavity, the cavity extending through the airfoil;
the first surface comprising a radial outer load bearing surface surrounding the cavity;
the second surface comprising a radial inner load bearing surface surrounding the cavity and opposite the radial outer load bearing surface;
a tangential interface between the radial outer load bearing surface and the radial inner load bearing surface; and
a moment interface surface between the radial outer load bearing surface and the radial inner load bearing surface and opposite the tangential interface;
wherein the mounting member attaches the nozzle to a surrounding static surface.

2. The nozzle of claim 1, wherein the nozzle is a ceramic matrix composite or a metal.

3. The nozzle of claim 1, wherein the nozzle is mounted in a cantilevered arrangement.

4. The nozzle of claim 1, wherein the mounting member includes an axial interface adjacent the moment interface and between the radial outer load bearing surface and the radial inner load bearing surface.

5. The nozzle of claim 1, wherein mounting member is machined to form the tangential load bearing surface and the moment interface surface.

6. A ceramic to metal attachment system comprising:
a nozzle, the nozzle including:
a first band;
a second band;
an airfoil joining the first band and the second band; and
a mounting member integrally formed with the second band and the airfoil, the mounting member having a first surface and a second surface, the mounting member including:
a cavity, the cavity extending through the airfoil;
the first surface comprising a radial outer load bearing surface surrounding the cavity;
the second surface comprising a radial inner load bearing surface surrounding the cavity and opposite the radial outer load bearing surface;
a tangential interface between the radial outer load bearing surface and the radial inner load bearing surface; and
a moment interface surface between the radial outer load bearing surface and the radial inner load bearing surface and opposite the tangential interface;
wherein the mounting member attaches the nozzle to a surrounding static surface;
a nozzle hanger for receiving the nozzle, the nozzle hanger including:
a nozzle receiving surface;
a shroud hanger integrally formed with and adjacent to the nozzle receiving surface;
an axial load bearing surface approximately perpendicular to the nozzle receiving surface;
a tangential load bearing surface approximately perpendicular to the nozzle receiving surface;
a moment load bearing surface opposite the tangential load bearing surface; and
a sealing member surrounding the cavity and situated between the nozzle receiving surface and the nozzle;

wherein the nozzle hanger receives a nozzle and transfers load of the nozzle and the hanger to a surrounding static structure;

a clamping member adjacent the second surface of the nozzle and the mounting member of the nozzle; and a plurality of attachment members, the attachment members securing the nozzle, the clamping member and the nozzle hanger together;

wherein the sealing member of the nozzle hanger seals off the airfoil from adjacent airflow.

7. The ceramic to metal attachment system of claim 6, wherein the nozzle is a ceramic matrix composite or a metal.

8. The ceramic to metal attachment system of claim 6, wherein the nozzle hanger is a metal.

9. The ceramic to metal attachment system of claim 6, wherein the clamping member includes a plurality of raised surfaces.

10. The ceramic to metal attachment system of claim 6, wherein the shroud hanger attaches the nozzle hanger to a shroud.

11. The ceramic to metal attachment system of claim 6, wherein the clamping member is a metal.

* * * * *